United States Patent [19]

Joannou

[11] Patent Number: 4,549,887

[45] Date of Patent: Oct. 29, 1985

[54] ELECTRONIC AIR FILTER

[76] Inventor: Constantinos J. Joannou, 2008 Dorval Ave., Ottawa, Ontario, Canada, K1G 2N8

[21] Appl. No.: 456,853

[22] Filed: Jan. 10, 1983

[51] Int. Cl.[4] ..... B03C 3/09

[52] U.S. Cl. ..... 55/131; 55/137; 55/143; 55/145; 55/146; 55/155; 55/493

[58] Field of Search ..... 55/131, 136, 137, 139, 55/143, 145, 146, 155, 480, 493, 509

[56] References Cited

U.S. PATENT DOCUMENTS

| | | | |
|---|---|---|---|
| 1,062,942 | 5/1913 | Woods | 55/509 X |
| 1,862,659 | 6/1932 | Christofferson | 55/493 |
| 2,639,781 | 5/1953 | Savitz | 55/139 X |
| 3,073,094 | 1/1963 | Landgraf et al. | 55/131 |
| 3,392,509 | 7/1968 | Pelosi, Jr. | 55/155 X |
| 3,438,180 | 4/1969 | Klouda | 55/131 |
| 3,513,634 | 5/1970 | Angonese et al. | 55/139 |
| 3,724,174 | 4/1973 | Walkenhorst | 55/155 X |
| 3,841,145 | 10/1974 | Boubel | 55/493 X |
| 4,166,729 | 4/1979 | Thompson et al. | 55/143 X |
| 4,261,712 | 4/1981 | Kinkade | 55/143 X |
| 4,264,343 | 4/1981 | Natarajan et al. | 55/155 X |

FOREIGN PATENT DOCUMENTS

| | | | |
|---|---|---|---|
| 607756 | 11/1960 | Canada | 55/131 |
| 1350576 | 3/1963 | France | 55/493 |

*Primary Examiner*—Kathleen J. Prunner

*Attorney, Agent, or Firm*—George M. Cooper

[57] ABSTRACT

This invention provides an improved electronic air filter comprising fibrous material such as glass fibers which are polarized by insulated screens. The screens are charged with high voltage provided by a power supply which is an integral part of the filter unit. This arrangement provides a filter with extremely low ozone emission.

6 Claims, 5 Drawing Figures

ELECTRONIC AIR FILTER

This invention relates to electronic filters and in particular filters in which the dust collecting element is some fibrous dielectric material which is placed between charged screens.

This art was developed many years ago, as is indicated by previous patents, such as U.S. Pat. No. 2,297,601 to Charles W. Williams. This patent teaches an arrangement of charged screens with fibrous material between them. Similar arrangements based on the same principle are shown in U.S. Pat. Nos. 2,597,927; 2,612,996; 2,740,184; 3,509,696 and 3,763,633.

All of the arrangements shown in the above patents have one very severe drawback. The fibrous material used between the charged screens is physically in electrical contact with the screens and any moisture on the surface of the fibers causes electrical discharge along the fibers thus causing drain on the power supply and also generating ozone which is harmful to health. Also, the package arrangement of these filters is awkward and makes the filters difficult to install. As a result of the drawback of this arrangement, commercial success of these filters has been minimal.

It is an object of my invention to provide an air filter which is free of the above drawbacks by insulating the screens so that no electric discharge can occur between them. Another object of my invention is to provide a filter which is compact and easy to install and which has a power supply as an integral part of the filter. Another object of my invention is to provide a filter which can be used as a direct replacement of the ordinary filters in house furnaces. Another object of my invention is to provide a filter in which the fibrous filter elements can be easily replaced after they have been saturated with dust. Another object of my invention is to provide a filter which features a special safety switch which short-circuits the high voltage automatically when the screens are open for servicing. Yet another object of my invention is to provide a power supply system which is safe to install without requiring high voltage wiring.

These and other objects of my present invention will become apparent by studying the drawings and descriptions which follow.

In drawings which illustrate embodiments of my invention,

Figure 1:
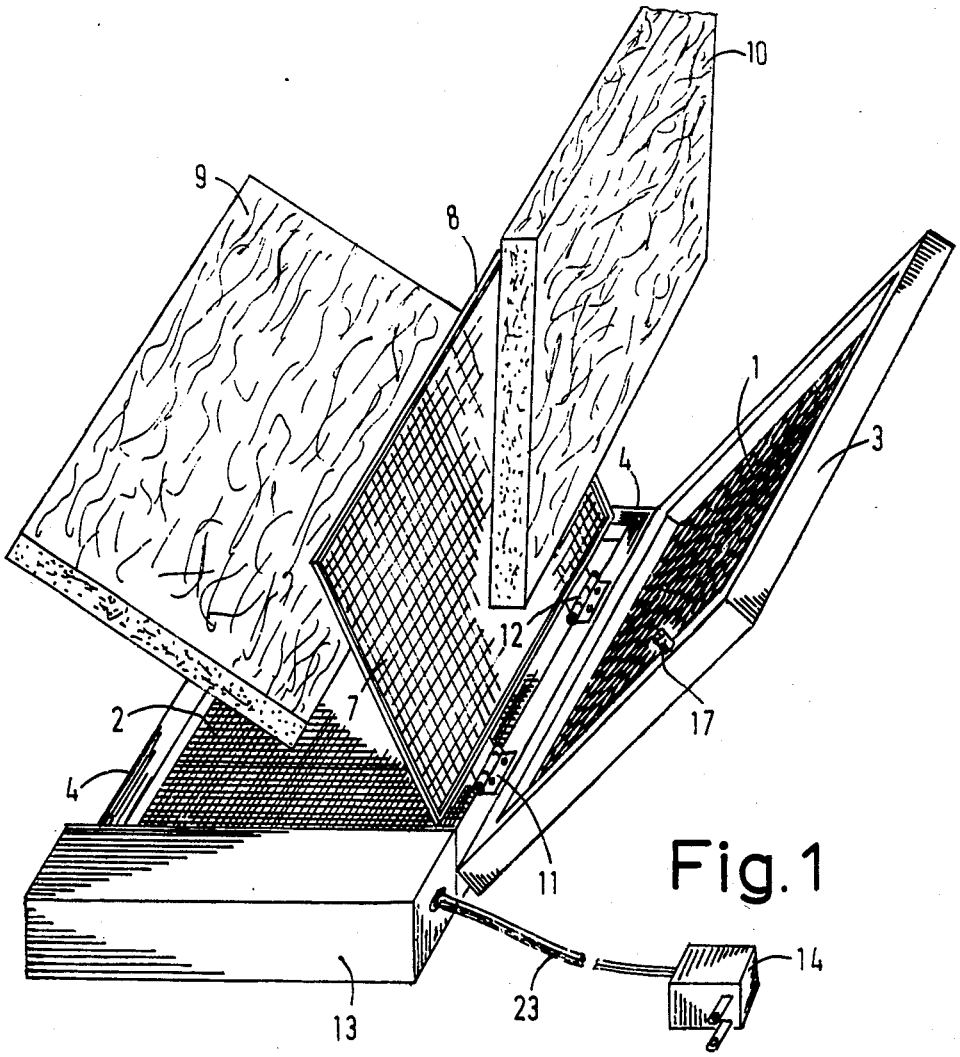
FIG. 1 shows the filter open exposing the fibrous material and the inside of the screen.
Figure 2:
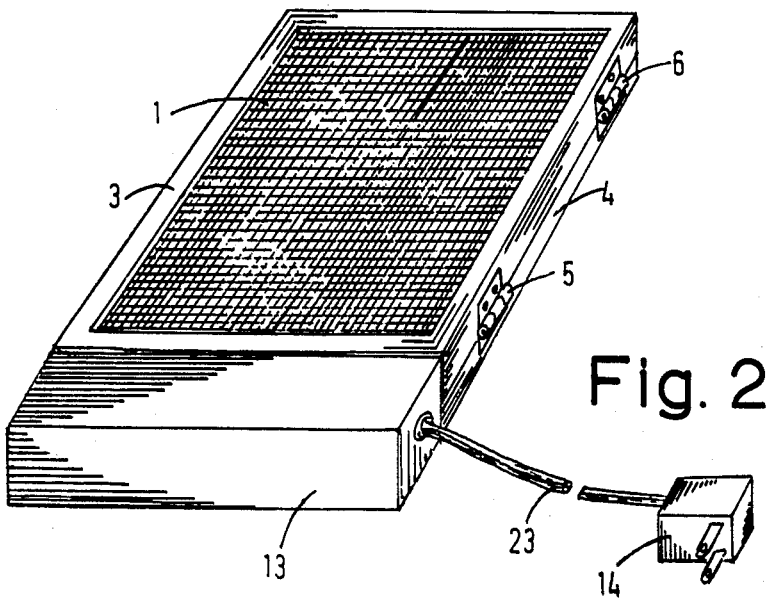
FIG. 2 shows the outside of the filter.

In FIG. 1, elements 1 and 2 are two outside screens made of metal such as aluminum. These screens are supported by hollow metallic frames 3 and 4, respectively. Frames 3 and 4 are attached to each other by hinges 5 and 6 (See also FIG. 2). 7 is a middle screen which is peripherally supported by frame 8. 9 and 10 are fibrous pads which are made from, for instance, fibrous glass material which fit between the inside screen 7 and the outside screens 1 and 2 (See FIG. 3). Frame 8 is made of an inside metallic frame **8*a* and an outside frame 8*b*. Frame 8*b* is made of an insulating material (plastic) such as nylon, polypropelene, etc. Frame 8*a* supports screen 7 and frame 8*b* covers frame 8*a* and edges of screen 7. Frame 8 is affixed to frame 4 by insulated hinges 11 and 12. Screens 1, 2 and 7 are coated with a thin insulating coating such as silicon, rubber, teflon, acrylic enamel, varnish, polyurethane, etc. 13 is a metal box containing an electronic high voltage supply. The high voltage produced by this supply is connected to screen 7 via an insulated wire (not shown). The ground return of the supply is connected to screens 1 and 2 via high voltage supply box 13 and frames 3 and 4. High voltage power supply 13 is energized by low voltage power supply 14 via cable 23. Power supply 14** is provided with standard prongs and can be plugged into any standard power outlet.

Figure 3:
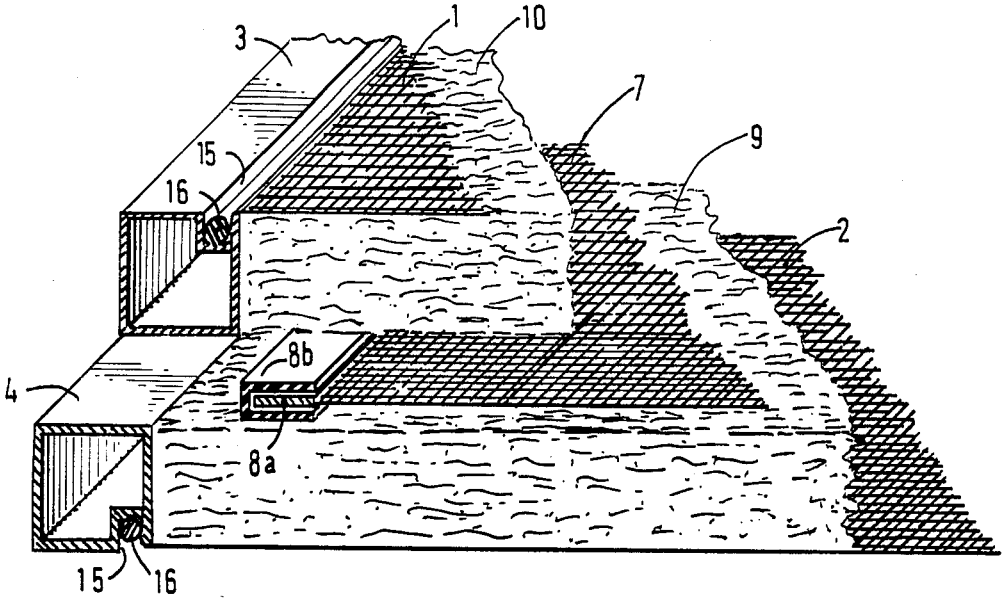
FIG. 3 shows a section of the filter to demonstrate its construction.

FIG. 3 shows the construction of the filter in greater detail. Frames 3 and 4 are constructed with hollow members which are provided with grooves 15. Screens 1 and 2 are attached to frames 3 and 4 by squeezing the edges of the screens into grooves 15 with resilient chord 16 and they are held there by the forces of friction provided by chord 16 pressing against the walls of grooves 15.

Figure 4:
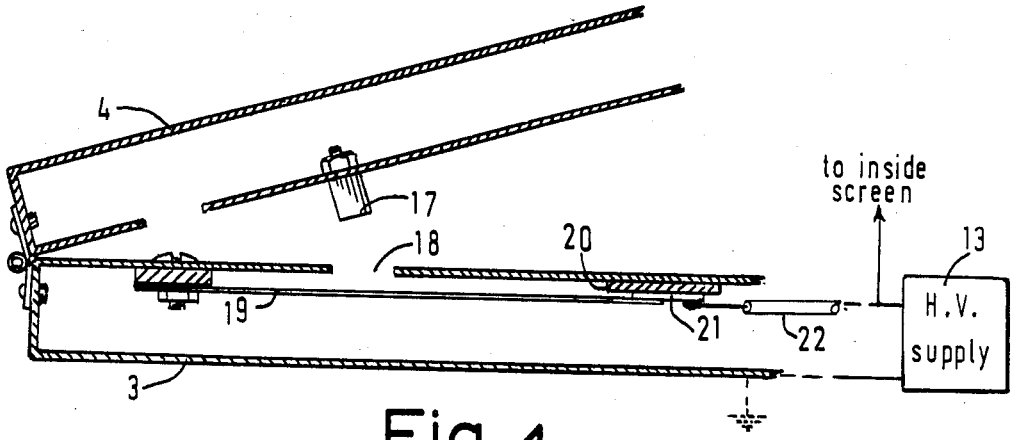
FIG. 4 shows the shorting switch inside the frame of the filter when the filter is open.
Figure 5:
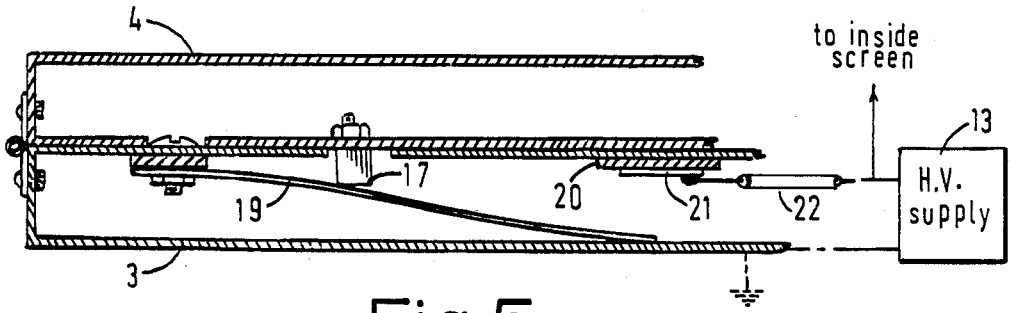
FIG. 5 shows the shorting switch inside the frame of the filter when the filter is closed.

FIGS. 4 and 5 show the operation of a shorting switch which is used to disable the high voltage when the filter is opened. 17 is a plunger which is positioned on frame 4. 18 is a hole on frame 3 opposite plunger 17. 19 is a spring element supported at one end inside frame 3. 20 is an insulator affixed inside frame 3. 21 is a metal contactor affixed to insulator 20. 22 is a wire connecting contactor 21 to the high voltage terminal of the supply 13.

Operation of the filter is simple. Low voltage supply 14 supplies low voltage power (6–15 volts) to high voltage supply 13 via cable 23. By using this arrangement, installation of the filter is easier and less dangerous since no power line wires are involved. High voltage from power supply 13 is applied to the insulated center screen 7. This produces a strong electric field between this screen and the outside screens 1 and 2. The fibrous pads 9 and 10 which fill the space between the screens are exposed to this electric field and they become polarized, i.e. positive and negative electric poles appear at the surface of each fiber. These electric poles attract particulate matter from the air which passes through the filter and thus it enhances the effectiveness of the filter in collecting dust. Dust, collected on the fibrous pads and which under humid conditions may be conducting, is prevented from carrying current (arching) from the inside screen 7 to the outside screens 1 and 2 by the insulation provided by the coating on the screens. Thus, the filter will not produce any ozone since there is no electric discharge.

To prevent the hazard of shock when changing the fibrous pads, the shorting switch is provided. When the filter is opened, plunger 17 releases spring 19 and allows it to touch contactor 21, thus connecting high voltage wire 22 to the ground (frame) via contactor 21.

What I claim is:

1. An electronic filter, comprising:

first and second outside metallic screens;

first and second outside metal frames, said first and second outside screens being mounted in and supported by said first and second outside frames, respectively;

first hinge means connecting said first and second frames together along corresponding edges thereof, said first and second screens being moveable between a closed, parallel position and an open position;

an inside metallic screen;

an inside frame, constructed of electrically insulating material, said inside screen being mounted in and supported by said inside frame;

second hinge means pivotally mounting said inside frame to one of said outside frames, said inside screen being between and parallel to said outside screens when said outside screens are in said closed position, said inside screen being electrically insulated from said outside screens;

a high voltage power supply unit secured to one of said outside frames, said high voltage power supply being electrically connected across said inside and outside screens; and first and second removable fibrous pads positionable between said inside screen and said first and second outside screens, respectively, said pads being removable when said outside screens are in said open position.

2. The electronic filter of claim 1, further including an insulating coating on each of said first and second outside screens and on said inside screen.

3. The electronic filter of claim 2, wherein said first and second hinge means are mounted on the same edge of an outside frame.

4. The electronic filter described in claim 3, in which each of said fibrous pads are made of fibrous glass material.

5. The electronic filter described in claim 3, further including:

switch means mounted in one of said first and second outside frames and connected so as to disable said high voltage power supply when said outside frames are moved to said open position.

6. The electronic filter described in claim 3, in which said outside frames are provided with grooves and further including resilient cord means for said grooves, whereby said outside screens are affixed to corresponding said outside frames by placing the edges of said screens in said grooves of their corresponding frames and press-fitting said resilient cord means into said grooves in order to hold said screens by the force of friction provided by said cords.

* * * * *